US008261470B2

(12) United States Patent
Wines et al.

(10) Patent No.: US 8,261,470 B2
(45) Date of Patent: Sep. 11, 2012

(54) MODULAR FOOTWEAR

(76) Inventors: Robert Wines, Broadview, IL (US); Betty Wines, Broadview, IL (US); Emiel Homberlin, Chicago, IL (US); Minnie Homberlin, Chicago, IL (US)

( * ) Notice: Subject to any disclaimer, the term of this patent is extended or adjusted under 35 U.S.C. 154(b) by 524 days.

(21) Appl. No.: 12/512,241

(22) Filed: Jul. 30, 2009

(65) Prior Publication Data

US 2011/0023325 A1 Feb. 3, 2011

(51) Int. Cl.

| | |
|---|---|
| ***A43B 3/24*** | (2006.01) |
| ***A43B 23/07*** | (2006.01) |
| ***A43B 7/06*** | (2006.01) |
| ***A43B 3/26*** | (2006.01) |

(52) U.S. Cl. ..... 36/100; 36/55; 36/3 B; 36/97

(58) Field of Classification Search ..... 36/100, 36/55, 3 B, 97, 101

See application file for complete search history.

(56) References Cited

U.S. PATENT DOCUMENTS

| | | | | |
|---|---|---|---|---|
| 5,499,459 | A * | 3/1996 | Tomaro | 36/10 |
| 6,467,191 | B2 * | 10/2002 | Hayashi et al. | 36/3 B |
| 7,636,974 | B2 * | 12/2009 | Meschter et al. | 12/146 C |
| 2003/0093919 | A1 * | 5/2003 | Wang | 36/10 |
| 2004/0244221 | A1 * | 12/2004 | Hall et al. | 36/10 |
| 2007/0062067 | A1 * | 3/2007 | Covatch | 36/55 |
| 2008/0083138 | A1 * | 4/2008 | Lacorazza et al. | 36/97 |
| 2008/0163514 | A1 * | 7/2008 | Stassinopoulos | 36/100 |
| 2010/0236100 | A1 * | 9/2010 | Ho | 36/100 |

* cited by examiner

*Primary Examiner* — Ted Kavanaugh

(74) *Attorney, Agent, or Firm* — Jerry D. Haynes; Law Office of Jerry D Haynes

(57) ABSTRACT

The present invention relates to a modular footwear to provide a variety of footwear comprising: an outer enclosure, where the outer enclosure includes a base portion, a front portion, side portions and a rear portion, where the front portion includes an expansion joint and side portions include a first expansion joint and a second expansion joint; an inner enclosure, where the inner enclosure removably inserts within the outer enclosure through a first cavity; and a fastening mechanism, where said fastening mechanism secures the footwear to a foot of a user. In one exemplary embodiment, the fastening mechanism includes a plurality of eyelets along an edge of the side portions and laces, where said laces pass through the eyelets. The rear portion may include a peripheral portion, where said peripheral portion includes a first attachment mechanism for enabling a detachable engagement of the outer enclosure with the inner enclosure.

12 Claims, 2 Drawing Sheets

MODULAR FOOTWEAR

CROSS REFERENCE TO RELATED APPLICATIONS

This application claims priority to U.S. Provisional Application Ser. No. 61/079,240 filed on Jul. 9, 2008.

FIELD OF THE INVENTION

The present invention generally relates to footwear, and, more specifically, to modular footwear for customization of different needs of an individual, thereby providing versatility.

DESCRIPTION OF RELATED ART

Footwear is an article of garment worn on feet. Footwear such as shoes, boots, and the like, is worn by people for multitude of reasons such as protection against environment, hygiene and adornment. As such, footwear may be protective, functional, therapeutic, decorative, or a combination thereof. Footwear industry has grown in leaps and bounds, and the growth is ever increasing. Footwear is an important part of fashion industry and has become a fashion statement for people from all segments. Earlier, people had limited options of footwear. However, in the present times people have wide variety of footwear to choose from.

Presently, different types of footwear are known for catering different needs of an individual such as for walking, jogging, athletic activities, formal occasions, casual occasions, and the like. These different types of footwear for different needs of individuals pose a problem for the individual in many respects, such as storage, cost, and the like. The problem is further aggravated when the individual has to travel for any reason. The individual is faced with the problem of carrying different types of footwear, which in turn occupy a substantial space of the individual's luggage, thereby significantly increasing weight of the luggage. Further, individuals may possess a variety of footwear, such as different colored shoes, for a single specific purpose, thereby causing another storage problem. Furthermore, requirements of people for footwear vary based on individual choice and taste for footwear. However, it may be difficult for the footwear industry to accommodate the choice and taste of each individual, and, as such people may have to compromise with regard to their choice and taste of the footwear. Also, occasionally individuals suffer from foot problems such as swelling, wound, sensitivity, tenderness, and the like which interfere with the individual's comfort and the ability to walk. In such cases, the footwear possessed by the individual may not be adapted for use with feet requiring special protection during such foot problems, and the individual may be required to buy new footwear, thereby causing the individual to incur additional expense.

Accordingly, a need exists for a modular footwear readily adaptable to provide multitude of options and variety in footwear to an individual without compromising on the choice, taste and comfort of the individual. Therefore, it is an object of the present invention to obviate the above and other disadvantages from existing art and to provide a modular footwear readily adaptable to provide single solution for different needs of an individual with regards to footwear. It is further an object of the present invention to provide a modular footwear which is comfortable, lightweight, durable, attractive, and has low production cost.

SUMMARY OF THE INVENTION

The present invention relates to a modular footwear to provide a variety of footwear comprising: an outer enclosure, where the outer enclosure includes a base portion, a front portion, side portions and a rear portion, where the front portion includes an expansion joint and side portions include a first expansion joint and a second expansion joint; an inner enclosure, where the inner enclosure removably inserts within the outer enclosure through a first cavity; and a fastening means, where said fastening means secures the footwear to a foot of a user. In one exemplary embodiment, the fastening means includes a plurality of eyelets along an edge of the side portions and laces, where said laces pass through the eyelets. The rear portion may include a peripheral portion, where said peripheral portion includes a first attachment means for enabling a detachable engagement of the outer enclosure with the inner enclosure.

DETAIL DESCRIPTION

The present invention relates to modular footwear readily adaptable to provide variety in footwear to an individual without compromising on the choice, taste and comfort of the individual. It is envisioned that the present invention may be easily incorporated to cover multitude of utility, which include, but are not limited to, walking, jogging, athletic activities, formal occasions, and casual occasions.

Figure 1:
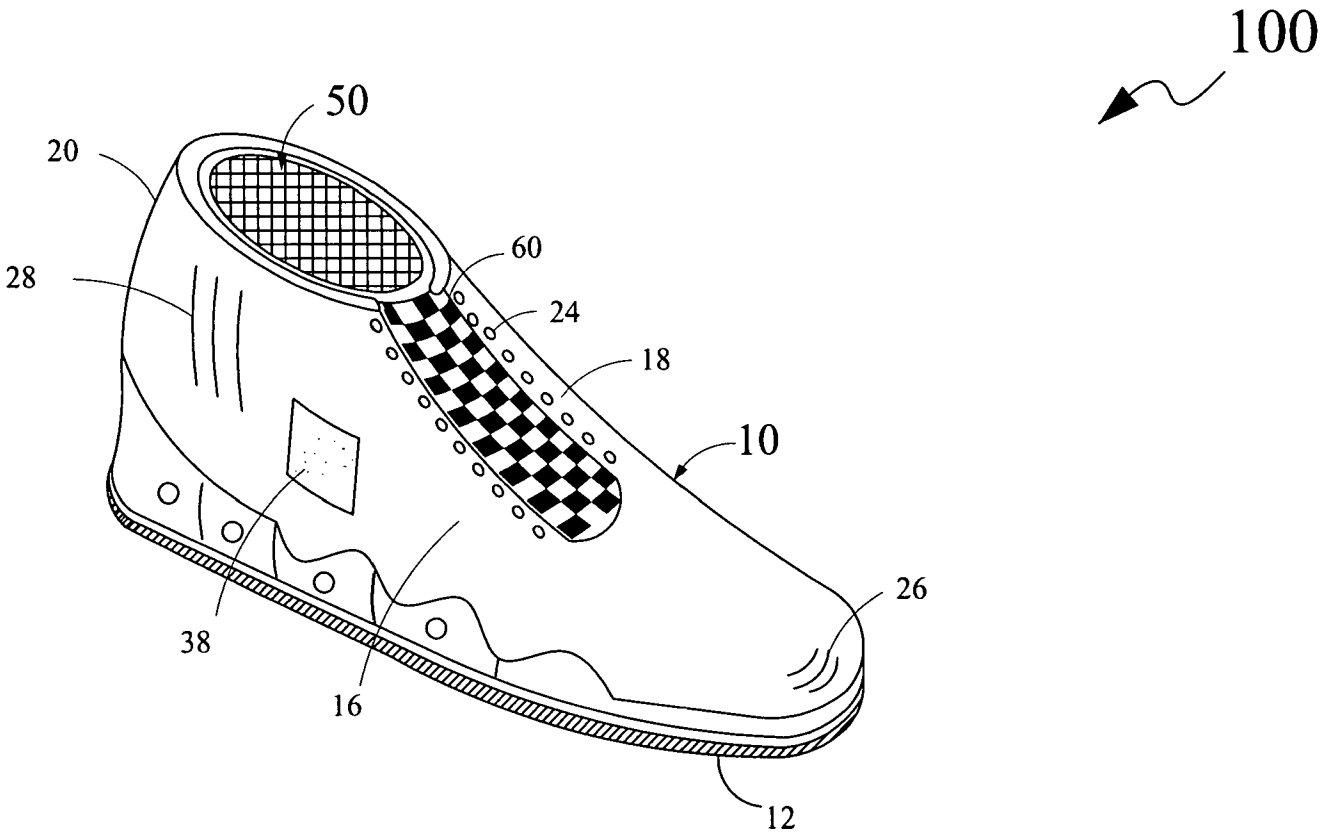
FIG. 1 illustrates modular footwear, in accordance with an embodiment of the present invention.

As illustrated in FIG. 1, the present invention provides modular footwear, such as modular footwear 100, in accordance with an embodiment of the present invention. The modular footwear 100 includes various detachable components readily adapted to configure multitude of structural designs. More specifically, the modular footwear 100 includes an outer enclosure 10, and an inner enclosure 50 configured to be removably inserted within the outer enclosure 10.

Figure 2A:
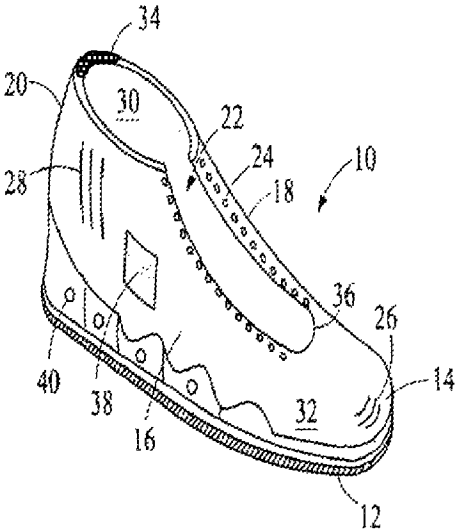
FIG. 2A illustrates an outer enclosure of modular footwear, in accordance with an embodiment of the present invention.

With reference to FIGS. 1 and 2A, the outer enclosure 10 includes a base portion 12, a front portion 14, side portions 16, 18, and a rear portion 20. The front portion 14, the side portions 16, 18, and the rear portion 20 of the outer enclosure 10 may be configured on a peripheral portion of the base portion 12 by any of the processes known in the art. The base portion 12, the front portion 14, the side portions 16, 18, and the rear portion 20 are configured in a manner to collectively give the outer enclosure 10 an appearance of footwear such as a shoe. The base portion 12, the front portion 14, the side portions 16, 18, and the rear portion 20 configure a first cavity 22 of the outer enclosure 10 for receiving the inner enclosure 50 therein. The configuration of the inner enclosure 50 may be explained further in detail in conjunction with FIG. 2D. The outer enclosure 10 may be made of footwear materials, such as leather, vinyl, suede, woven material, rubber, plastic, and the like. It will be apparent to those skilled in the art that the structural configuration and material of the outer enclosure 10 as set forth herein are for purposes of illustration and are not to be construed as limiting.

The side portions 16, 18 are configured to cover foot of the user from sides. In order to keep the modular footwear 100 secure with a foot of a user, the side portions 16, 18 may be provided with fastening means. In an embodiment of the present invention, the fastening means may include a plurality of eyelets such as eyelet 24 present on the side portions 16, 18 as shown in FIG. 2A. Laces may be passed through the plurality of eyelets to securely hold the modular footwear 100 on the foot of the user. In another embodiment of the present invention, the fastening means may include snap fasteners (not shown). In yet another embodiment of the present, the fastening means may include hook and loop fastening elements. The fastening means as set forth herein are for purposes of illustration and are not to be construed as limiting.

The front portion 14 of the outer enclosure 10 includes an expansion joint 26 configured to readily allow a foot of the user within the modular footwear 100 in circumstances such as swelling, wound, sensitivity, tenderness, and the like. More specifically, the expansion joint 26 may be a plurality of slits which allow the outer enclosure to readily expand to allow the foot of the user within the modular footwear 100, thereby providing comfort to the user.

Further, the side portions 16, 18 of the outer enclosure 10 include a first expansion joint 28 and a second expansion joint (not shown), respectively configured to readily accommodate a foot of the user within the modular footwear 100. Each of the expansion joint 26, the first expansion joint 28 and the second expansion joint allows the foot of the user to enter into the modular footwear 100 with ease.

The outer enclosure 10 further includes an inner surface 30 and an outer surface 32. A peripheral portion of the rear portion 20 is provided with first attachment means 34 for enabling a detachable engagement of the outer enclosure 10 with the inner enclosure 50 upon inserting the inner enclosure 50 within the outer enclosure 10. In an embodiment of the present invention, the first attachment means 34 may include snap fastener elements. In another embodiment of the present invention, the first attachment means 34 may include a hook and loop fastening arrangement. The first attachment means 34 as set forth herein are for purposes of illustration and are not to be construed as limiting.

Further, the side portions 16, 18 and the front portion 14 configure a tongue area 36 as shown in FIG. 2A. The tongue area 36 is adapted to receive a tongue (not shown). The tongue is similar in functionality to other footwear tongue known in the art. In an embodiment of the present invention, the tongue may be attached to the front portion 14. In another embodiment of the present invention, the tongue may be detachably attached to the front portion 14 by means of an attachment such as a hook and loop fastener. The tongue is adapted to occupy the tongue area 36 configured by the side portions 16, 18 and the front portion 14. The outer surface 32 is further provided with embellishment means 38 to enhance the aesthetic look of the modular footwear 100. The embellishment means 38 is adapted to removably attach decorations such as a logo, a personalized name tag, and the like to the outer surface 32 of the outer enclosure 10. In an embodiment of the present invention, the outer enclosure 10 further includes plurality of ventilation holes such as a ventilation hole 40 configured adjacent to the base portion 12 for facilitating transfer of air and removal of any moisture present in the modular footwear 100.

Figure 2B:
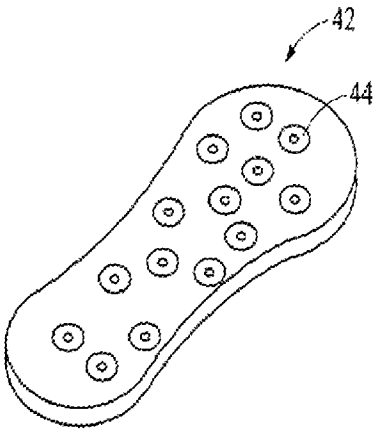
FIG. 2B illustrates a resilient sole of modular footwear, in accordance with an embodiment of the present invention.
Figure 2C:
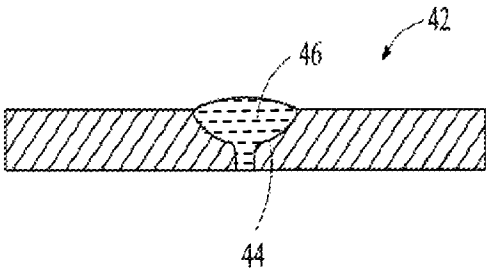
FIG. 2C illustrates cross sectional view of the resilient sole of FIG. 2B of the modular footwear, in accordance with an embodiment of the present invention.

With reference to FIGS. 2B and 2C, the outer enclosure 10 includes a resilient sole 42 configured to be placed in between the outer enclosure 10 and the inner enclosure 50. The resilient sole 42 provides cushioning and traction to the user wearing the modular footwear 100. The resilient sole 42 may be made of a durable and oil resistant material such as rubber material. The resilient sole 42 includes a plurality of apertures such as an aperture 44 to allow transfer of air in the modular footwear 100. The plurality of apertures of the resilient sole 42 such as the aperture 44, are adapted to receive plurality of removable ventilation parts such as a removable ventilation part 46 as shown in FIG. 2C. In an embodiment of the present invention, the removable ventilation part 46 may be made of an elastomer of thermoplastic resin or may be a gel plug. The removable ventilation part 46 provides the regulation of air flow within the modular footwear 100 and function as a cushion to absorb shock associated with walking, running and the like. The plurality of removable ventilation parts may be variable softness for the customization of the modular footwear 100 as per a user's requirement.

Figure 2D:
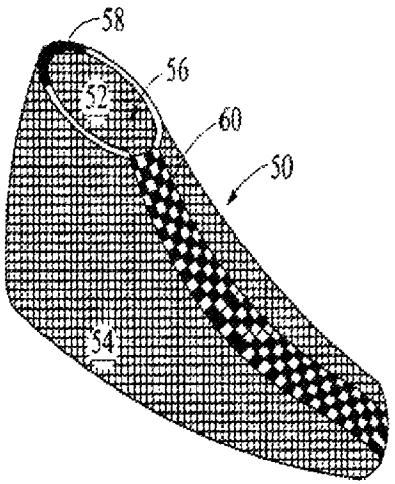
FIG. 2D illustrates an inner enclosure of modular footwear, in accordance with an embodiment of the present invention.

With reference to FIG. 2D, the inner enclosure 50 of the modular footwear 100 is illustrated, in accordance with an embodiment of the present invention. The inner enclosure 50 includes an interior surface 52 and an exterior surface 54. The inner enclosure 50 is configured to be detachably received within the first cavity 22 of the outer enclosure 10. The inner enclosure 50 further includes a second cavity 56 configured within the interior surface 52 of the inner enclosure 50 and adapted to receive the foot of the user. Moreover, the inner enclosure 50 includes second attachment means 58 configured on the exterior surface 54 of the inner enclosure 50. The second attachment means 58 are adapted to cooperate with the first attachment means 34 of the outer enclosure 10 in order to securely hold the inner enclosure 50 within the outer enclosure 10. Further, the inner enclosure 50 includes an upper portion 60 as shown in FIG. 2D. The upper portion 60 may be made of a soft and flexible material adapted to provide comfort to the user of the modular footwear 100. The upper portion 60 may be located beneath the tongue area 36 of the outer enclosure 10, when the inner enclosure 50 is placed within the outer enclosure 10. The upper portion 60 may act as a cushion to provide maximum comfort and stability to the user. The upper portion 60 may be made of non-shrinkable material and may have multitude of color patterns to enhance the aesthetic look of the modular footwear 100.

In use, the inner enclosure 50 may be inserted into the outer enclosure 10. More specifically, the inner enclosure 50 may be placed within the first cavity 22 of the outer enclosure 10 in a manner such that the upper portion 60 is located beneath the tongue area 36 of the outer enclosure 10. In an embodiment of the present invention, the tongue may be detachably attached to the front portion 14 of the outer enclosure 10 by means of an attachment such as a hook and loop fastener configured on the tongue and the front portion 14. In another embodiment of the present invention, the upper portion 60 may act as the tongue for the modular footwear 100, thereby precluding a need attaching a separate tongue with the front portion 14. Further, the first attachment means 34 of the outer enclosure 10 may detachably engage with the second attachment means 58 of the inner enclosure 50 to securely hold the inner enclosure 50 within the outer enclosure 10. In order to regulate the air flow inside the modular footwear 100, the plurality of apertures such as the aperture 44 may be accordingly closed with the plurality of removable ventilation parts such as the removable ventilation part 46. Once the modular footwear 100 has been configured as per the preference of the user, the modular footwear 100 is ready to be used by the user. More specifically, the user may enter/slip his/her foot within the second cavity 56 of the inner enclosure 50 of the modular footwear 100. Thereafter, the modular footwear 100 may be secured with the foot of the user by fastening means provided on the outer enclosure 10. The modular footwear 100 may also be readily adaptable to accommodate the foot of the user in circumstances where the user has swelling, wound, sensitivity, tenderness, and the like. Further, decorations such as a logo, a personalized name tag, and the like are adorned on the modular footwear by attaching the same with the embellishment means 38 to enhance the aesthetic look of the modular footwear 100 and to make the modular footwear stylish and trendy.

It is to be noted that the modular footwear 100 is not limited to the exemplary configuration as described herein with respect to the FIGS. 1 through 2D, but, the modular footwear 100 may include a multitude of configurational arrangements. Further, structural designs of footwear for men are different from that of women. However, in the preferred embodiment of the present invention, the modular footwear has been explained, irrespective of the structural designs of the footwear for men or women, for the sake of brevity.

In an exemplary embodiment of the present invention, the outer enclosure 10 includes cushioning elements configured thereon to provide stability, comfort and style to the user of the modular footwear 100. In an embodiment of the present invention, detachable cushioning elements of variable thickness may be provided. The cushioning elements may be provided in multitude of color patterns to suit individual preferences of different people.

In another exemplary embodiment of the present invention, the inner enclosure 50 may be configured with a layer of memory foam to provide additional stability, comfort and style to the user of the modular footwear 100.

The present invention provides multi-functional footwear without compromising on the stability, comfort and style to the user. The modular footwear 100 maybe made in multitude of size, shapes, designs, and color patterns in order to meet preferences, choices and requirements of different users.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

What is claimed is:

1. A modular footwear to provide a variety of footwear comprising:

a. an outer enclosure, where the outer enclosure includes a base portion, a front portion, side portions and a rear portion, where the front portion includes an expansion joint and side portions include a first expansion joint and a second expansion joint;

b. an inner enclosure, where the inner enclosure removably inserts within the outer enclosure through a first cavity;

c. a first attachment means positioned on a peripheral portion of said rear portion of said outer enclosure;

d. a second attachment means configured on an outer surface of the inner enclosure, where said first attachment means and said second attachment means enable a detachable engagement of said outer enclosure with said inner enclosure e. a resilient sole configured between said outer enclosure and said inner enclosure, where said resilient sole includes a plurality of apertures where said apertures allow air to transfer in the modular footwear; and f. a fastening means, where said fastening means secures the footwear to a foot of a user.

2. The modular footwear according to claim 1, where said fastening means includes a plurality of eyelets along an edge of the side portions and laces, where said laces pass through the eyelets.

3. The modular footwear according to claim 1, where said first attachment means includes a hook and loop fastening arrangement.

4. The modular footwear according to claim 1, where the side portions and front portion configure a tongue area adapted to receive a tongue, where said tongue is detachably attached to the front portion.

5. The modular footwear according to claim 1, where said outer enclosure includes an inner surface and an outer surface, where the outer surface includes an embellishment means, where the embellishment means is removable.

6. The modular footwear according to claim 1, where said outer enclosure includes a plurality of ventilation holes.

7. The modular footwear according to claim 1, where said plurality of apertures are adapted to receive a plurality of removable ventilation parts, where said removable ventilation parts are made from a gel plug.

8. The modular footwear according to claim 1, where said inner enclosure includes an interior surface and an exterior surface, where the interior surface includes a second cavity that receives the foot of a user and the exterior surface includes a second attachment means adapted to cooperate with the first attachment means.

9. The modular footwear according to claim 1, where said inner enclosure includes an upper portion, where said upper portion is located beneath the tongue area of the outer enclosure.

10. The modular footwear according to claim 9, where said upper portion acts as a tongue for the modular footwear.

11. The modular footwear according to claim 1, where the outer enclosure is made of as least one of leather, vinyl, suede, woven material, rubber and plastic.

12. The modular footwear according to claim 1, where the first expansion joint and the second expansion joint are a plurality of slits which allow the outer enclosure to readily expand to allow the foot of the user within the modular footwear.

* * * * *